United States Patent [19]

Lowry

[11] Patent Number: 4,870,980

[45] Date of Patent: Oct. 3, 1989

[54] TOBACCO EXPANSION PROCESS AND APPARATUS

[75] Inventor: Gerald R. Lowry, Winston-Salem, N.C.

[73] Assignee: R. J. Reynolds Tobacco Company, Winston-Salem, N.C.

[21] Appl. No.: 36,938

[22] Filed: Apr. 10, 1987

[51] Int. Cl.[4] ..... A24B 3/18

[52] U.S. Cl. ..... 131/296

[58] Field of Search ..... 131/296

[56] References Cited

U.S. PATENT DOCUMENTS

| | | | |
|---|---|---|---|
| 3,524,451 | 8/1970 | Fredrickson . | |
| 3,575,178 | 4/1971 | Stewart . | |
| 3,693,631 | 9/1972 | Moore et al. . | |
| 3,780,744 | 12/1973 | Neel et al. . | |
| 3,788,331 | 1/1974 | Neel et al. . | |
| 4,195,647 | 4/1980 | Wochnowski et al. | 131/296 |
| 4,333,483 | 6/1982 | de la Burde et al. . | |
| 4,460,000 | 7/1984 | Steinberg | 131/296 |

*Primary Examiner*—Vincent Millin

*Attorney, Agent, or Firm*—Stephen M. Rodenheimer, Jr.

[57] ABSTRACT

A process and apparatus for improved expansion of tobacco is disclosed wherein tobacco impregnated with a volatile impregnant is treated prior to expansion, in an intermediate stage wherein a gaseous phase containing volatile impregnant vapors is removed and later recovered. The thus treated tobacco is thereafter expanded in a conventional expansion zone by contacting the tobacco with a stream of hot gases. The invention results in more efficient use of volatile impregnant and can provide less residual impregnant in expanded tobacco while not decreasing the degree of tobacco expansion.

16 Claims, 1 Drawing Sheet

TOBACCO EXPANSION PROCESS AND APPARATUS

FIELD OF THE INVENTION

The invention relates to process and apparatus for expanding tobacco. More specifically, the invention relates to a tobacco expansion process and apparatus wherein tobacco is impregnated with a volatile impregnant and the resultant moistened tobacco treated in an expansion zone maintained under conditions causing the rapid volatilization of the impregnant with concomitant expansion of the tobacco.

DESCRIPTION OF RELATED ART

Tobacco expansion is disclosed in numerous U.S. and foreign patents and practiced commercially throughout the world. Major commercial tobacco expansion processes involve impregnating the tobacco with a volatile impregnant and then subjecting the impregnated tobacco to rapid heating to thereby volatilize the impregnant and expand the tobacco. Various impregnants have been used or proposed for use in tobacco expansion. One widely used group of impregnants are present as a liquid within the tobacco just prior to expansion.

More specifically, U.S. Pat. No. 3,524,451 to Fredrickson and U.S. Pat. No. 3,524,452 to Moser et al disclose impregnation of tobacco with an organic liquid and thereafter exposing the moistened tobacco to a stream of hot gas whereby the liquid is quickly vaporized with the simultaneous puffing or expansion of the tobacco particles. The impregnating liquid employed is substantially chemically inert with respect to the tobacco and falls generally in the classes of aliphatic hydrocarbons, aromatic hydrocarbons, alkanols, ketones, aliphatic esters, ethers, halogenated hydrocarbons and mixtures thereof. The latter group of organic compounds, particularly freons, have been widely used in the above process.

Modifications of the above described tobacco expansion processes are described in U.S. Pat. No. 3,575,178 to Stewart and in U.S. Pat. No. 3,693,631 to Moore et al, which disclose impregnation steps involving gaseous impregnant which is condensed as a liquid within the tobacco. In the '178 patent, tobacco is introduced into the lower portion of an impregnation zone maintained at superatmospheric pressure. A liquid pool of impregnant present in the lower portion of the zone impregnates the tobacco. The impregnant moistened tobacco is then conveyed to an upper portion of the zone and thereupon immediately passed to an expansion zone containing a rapidly moving stream of hot gas. In the '631 patent, tobacco and a stream of vapors of the impregnant are introduced into one end of an impregnation zone and moved in concurrent flow relation to the other end of the impregnation zone during which time the tobacco becomes thoroughly impregnated with the compound. The impregnant moistened tobacco is then passed directly into a vapor expansion zone comprising a stream of hot gas.

In addition, various processes have been disclosed for recovering the organic impregnant used in such tobacco expansion processes. U.S. Pat. No. 3,788,331 to Neel et al discloses one such process wherein the organic impregnant is recovered from the hot expansion gas stream by passing a portion of the gas stream into a lower section of a water scrubber comprising a packed tower. The hot gas is countercurrently contacted with water introduced at the upper end of the packed tower to thereby effect: removal of tobacco fines from the gas stream; cooling of the stream; condensation of a substantial portion of water present therein; and stripping of organic impregnant from process waste water introduced into the upper section of the tower. The organic impregnant is then condensed and recovered by conventional procedures.

U.S. Pat. No. 3,780,744 to Neel et al discloses recovery of vaporized organic liquid in such tobacco expansion processes by collecting organic impregnant containing vapors normally lost to the atmosphere from tobacco and passing sequentially the collected organic impregnant containing vapors through a separator and then through a bed of activated carbon.

It would be desirable to improve tobacco expansion processes by making more efficient use of organic impregnants and decreasing the loss thereof in tobacco expansion processes.

SUMMARY OF THE INVENTION

The invention provides processes and apparatus for improved expansion of tobacco. Process embodiments of the invention involve increasing the filling capacity of tobacco by impregnating the tobacco with a volatile impregnant in a first zone. Impregnated tobacco is removed from the first zone and rapidly passed through a discrete second zone wherein a gaseous phase containing the volatile impregnant is removed. Thereafter, the tobacco is expanded in a third discrete zone by contacting the tobacco with a stream of hot gases. The volatile impregnant removed in the second zone is recovered.

Apparatus embodiments of the invention include a means for impregnating tobacco with a volatile impregnant; a separate, short residence time, e.g., less than ten seconds, vapor removal means downstream of the impregnation means for removing impregnant vapors; and expansion means downstream of the vapor removal means for contacting the tobacco with a stream of hot gas with concomitant expansion of the tobacco. The processes and apparatus of the invention can provide more efficient use of organic impregnant in a tobacco expansion process and can result in less residual impregnant in the expanded tobacco.

BRIEF DESCRIPTION OF THE DRAWING

In the drawing which forms a part of the original description.

DESCRIPTION OF THE PREFERRED EMBODIMENTS

Figure 1:
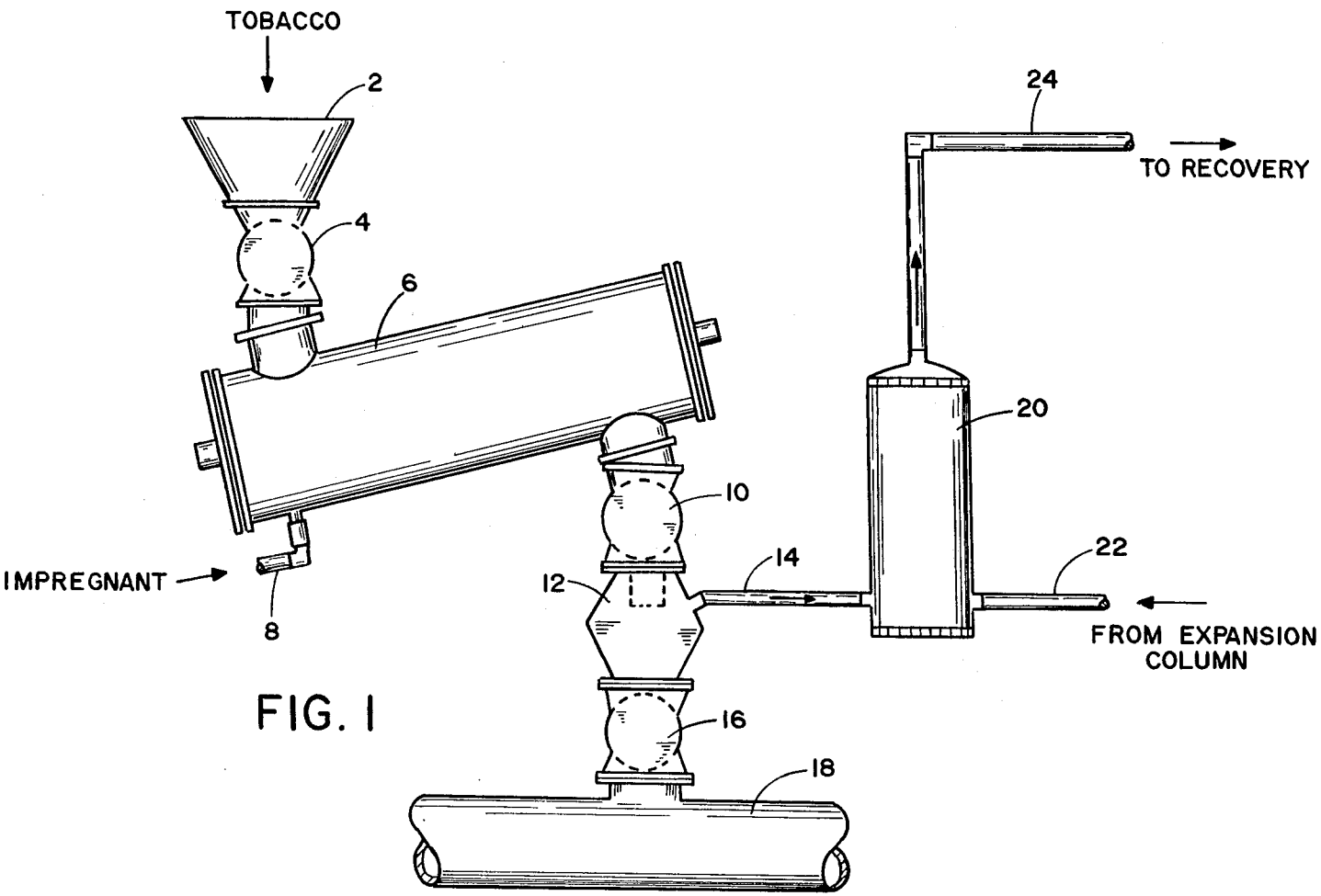
FIG. 1 illustrates one preferred apparatus embodiment of the invention which can be used to conduct the enhanced efficiency tobacco expansion process of the invention.

The improved efficiency tobacco process of the invention is best conducted using the continuous tobacco expansion processes in accordance with the teachings of U.S. Pat. No. 3,693,631 issued Sept. 26, 1972 to Moore et al, which is hereby incorporated by reference and in accordance with the teachings of U.S. Pat. No. 3,575,178 issued Apr. 20, 1971 to Stewart, which is hereby incorporated by reference. Such processes are considered to be continuous tobacco expansion processes.

FIG. 1 illustrates in schematic form, one preferred apparatus embodiment of the invention in which the process of the invention can be conducted. Shredded flue-cured or burley tobacco is charged to hopper, 2. Preferably, the tobacco has a water content of 10 to 30%, suitably about 18%, by weight. Various means, not shown, upstream of hopper 2 can be used to adjust the moisture content where desirable or necessary. Tobacco in hopper 2 is passed via star feed valve 4 or a similar pressure lock feed valve into impregnator 6 which is advantageously maintained under superatmospheric pressure. The impregnator advantageously maintained under superatmospheric pressure. The impregnator advantageously contains a screw conveyor (not shown) within its interior which, in turn, advances the tobacco through the impregnator from left to right as shown in the drawing.

Simultaneously, vapors of the impregnating compound are introduced via vapor line 8 into the interior of the impregnator. The impregnator preferably also includes an outer jacket (not shown) through which heat exchange media may be circulated for appropriate temperature control. The vapors come into contact with the tobacco within impregnator and at least a portion of the vapor is condensed on and in the tobacco particles. Feed rate of impregnant vapor passing through line 8 is determined by the pressure within the impregnator, which, in turn, is influenced by the rate at which relatively cool tobacco enters through valve 4. At a given pressure, which is selected on the basis of the particular impregnating fluid being used, the vapor feed rates are easily controlled to give an impregnated tobacco containing between 5 and about 200 parts by weight of impregnant per 100 parts of tobacco (dry basis). During the concurrent flow of tobacco and impregnant through impregnator 6, the tobacco is thoroughly impregnated with the volatile impregnant.

The tobacco is discharged from impregnator through star feed valve 10 and rapidly passed through an impregnant removal zone 12. As the impregnated tobacco stream passes removal zone 12, a vapor stream containing gaseous impregnant is removed via vapor line 14. Vapor line 14 is preferably maintained at a pressure substantially below that of impregnator 6, thus reducing the pressure within impregnant removal zone 12 substantially below that of the impregnation zone, and causing vapor to be removed via line 14. For example, impregnator can be operated at superatmospheric pressure of 20 psig. while pressure within the impregnant removal zone 12 can be at about atmospheric, i.e., 0 psig.

If desired, vapor removal from the vapor removal zone can be effected by arrangements other than the pressure differential arrangement discussed above. In one such arrangement, vapor removal can be effected by a sweep gas. For example, with reference to FIG. 1, impregnant removal zone 12 can be maintained at a pressure near but less than the pressure in impregnator 6, and a sweep gas can be introduced into zone 12 via an inlet line (not shown) to sweep impregnant vapors out of zone 12 through line 14. Such a sweep gas should preferably be at a temperature less than or about the same as the tobacco exiting impregnator, 6, and should have a composition substantially inert with respect to the tobacco, e.g., moist air. It will be recognized that with the star valve arrangement shown in FIG. 1, gas from vapor removal zone 12 will be continuously pumped back into impregnator 6 via star valve 10 and thus in this arrangement, any sweep gas introduced into zone 12 will be pumped into the impregnator. With such an arrangement, the sweep gas must not be at a pressure higher than that of impregnator 6, as will be apparent to those skilled in the art.

Tobacco residence time within impregnant removal zone 12 is short, preferably ten seconds or less, more preferably five seconds or less, most preferably three seconds or less, for example, one second. Thus, zone 12 is constructed and arranged as a short residence zone. This can be accomplished in various ways. For example, as shown in the drawing, the volume of zone 12 is small. Similarly, the relative speeds of pressure lock feed valves 10 and 16 can be varied to decrease residence time.

Tobacco is then discharged from zone 12 via star valve 16 into a rapidly moving stream of hot gas in duct 18 and then conveyed to a conventional expansion column which is advantageously substantially in the same form described in the aforementioned '631 and '178 patents. The hot gas in duct 18 has a temperature substantially greater than the boiling point of the impregnating compound at the prevailing pressure so that when the tobacco contacts the hot gas, the impregnating compound will vaporize or the vapors within the tobacco will expand to cause the concomitant expansion of tobacco. This expansion occurs within a short time (e.g., less than 10 seconds) during which the gas and tobacco flow through duct 18 and then upwardly through a conventional expansion column (not shown). Because of impregnant vapor removal in zone 12, this expansion in the hot gas stream can allow for a more complete removal of impregnant from tobacco than in prior expansion processes.

After expansion, the tobacco, heating gas and vapors of impregnating compounds are conveyed to a conventional cyclone separator from which the expanded tobacco is passed through an airlock and thereafter to conventional stripping and reordering means wherein the product is adjusted to the desired moisture content, suitably 12 to 14%. Gases including steam and vapors of impregnating fluid are withdrawn from the cyclone separator and are recycled and reheated to the desired extent and then recycled back through duct 18. A sidestream of the gases being recycled is withdrawn prior to heating and passed to scrubber 20 via vapor line 22. In the scrubber, the hot gas is countercurrently contacted with water introduced at the upper end of the packed tower via means, not shown, to thereby effect removal of tobacco fines from the gas stream, cooling of the gas stream, condensation of a substantial portion of the water present therein, and stripping of organic impregnant from process waste water. The thus treated vapor is passed via line 24 to conventional liquid recovery means wherein the vapor is condensed in liquid form, separated from water and can be recycled to impregnator 6. The aforedescribed scrubbing and vapor recovery operation is more fully described in U.S. Pat. No. 3,788,331 to Neel et al which is hereby incorporated by reference.

Similary, vapors withdrawn from impregnant removal zone 12 via line 14, which contain a substantial percentage of impregnant vapors, are also treated for recovery of impregnant. Again, with reference to FIG. 1, the vapors withdrawn from zone 12 are passed countercurrently through water scrubber 20, which is the same scrubber used to treat gases removed from the expansion column. Thus treated, the vapor is passed via line 24 to conventional liquid recovery means for condensation and purification of the impregnant. In the preferred arrangement of this invention, the vapors removed from zone 12 will be impregnant rich, i.e., contain a high percentage of impregnant. Accordingly, recovery of the impregnant is a relatively efficient process as opposed to prior art systems where this fraction of impregnant was mixed with gases in the expansion zone prior to recovery. It will be recognized that various recovery operations can be substituted for the scrubber/condensation process described above.

The invention has been described with reference to the continuous expansion process wherein impregnant is supplied to tobacco as a gas. It will be apparent that impregnator 6 can also be operated in the manner described in U.S. Pat. No. 3,575,178, according to which, a small pool of volatile impregnant liquid is maintained at the entrance end of the impregnator. Similarly, pressure within impregnator 6 can be maintained at atmospheric or subatmospheric pressures depending on temperature and on the nature of the impregnant. Other such modifications will be apparent.

EXAMPLE

A series of four tests were run on a pilot plant apparatus substantially in the form shown in FIG. 1. The impregnant used was freon 11 and the process was conducted substantially as described in U.S. Pat. No. 3,693,631. Substantially the same conditions were used during each of the four tests, as follows:

| Impregnant Zone Pressure | Impregnant Zone Temperature | Expansion Column Temperature At Heater In | Expansion Column Temperature At Heater Out |
|---|---|---|---|
| 20 psig | 125° F. | 250° F. | 305° F. |

Each of the above runs was conducted both with and without operation of the impregnant removal zone. When operating, the pressure within the impregnant removal zone was maintained at about atmospheric pressure and removed vapor passed directly to a scrubber as shown in FIG. 1. When the impregnant removal zone was not operating, a valve was closed in vapor line 14 (FIG. 1) so that no vapors were removed from the zone. In all cases, residence time in the impregnant removal zone was about one second or less. During all of the runs, measurements were made to determine effect of the vapor removal zone, as follows.

Percent freon in the expansion column (by volume) was measured by gas sampling at a location in the expansion zone just upstream of the location where tobacco falls into the column.

Freon use (gallons per hour) was measured by monitoring freon admitted to the system and freon recovered from the system. It is to be noted that in these tests freon was continuously recovered from the expansion column according to the process described in U.S. Pat. No. 3,788,331; but the post expansion freon recovery described in U.S. Pat. No. 3,780,744 was not used.

Residual freon in product (percent by weight) was measured by recovering a small sample of expanded tobacco immediately after expansion and solvent extracting freon from the expanded product.

Filling capacity was measured according to the procedure set forth in U.S. Pat. No. 3,524,452, the tobacco moisture level being corrected to 11½% for all measurements.

The results set forth in the following Table were obtained in the tests:

TABLE I

| | OPERATING | NOT OPERATING |
|---|---|---|
| Percent freon in the expansion column (by volume) | | |
| Run (1) | 8.75 | 36.3 |
| Run (2) | 3.7 | 32.6 |
| Run (3) | 2.2 | 33.6 |
| Run (4) | 9.0 | 22.0 |
| Freon use (gallons per hr.) | | |
| Run (1) | 53.9 | 74.0 |
| Run (2) | 53.0 | 78.0 |
| Run (3) | 54.5 | 70.0 |
| Run (4) | 54.0 | 72.0 |
| Residual freon in product (percent by weight) | | |
| Run (1) | 1.98 | 2.88 |
| Run (2) | 2.66 | 3.51 |
| Run (3) | 2.62 | 5.78 |
| Run (4) | 3.32 | 4.98 |
| Filling capacity (ml/100 gm - corrected to 11½% moist.) | | |
| Run (1) | 764 | 744 |
| Run (2) | 746 | 742 |
| Run (3) | 800 | 847 |
| Run (4) | 794 | 789 |

It can be seen that use of the vapor removal zone according to this invention resulted in substantially equivalent expansion of tobacco while freon use and residual freon in product were substantially decreased. The concentration of freon in the expansion column also decreased substantially thus improving the efficiency of the freon recovery process. Thus, the invention offers substantial enhancement to prior tobacco expansion processes.

The invention has been described in considerable detail with reference to preferred embodiments. However, modifications and variations can be effected within the spirit and scope of the invention as described in the foregoing specification and defined in the appended claims.

What is claimed is:

1. A process for increasing the filling capacity of tobacco comprising the steps:

impregnating tobacco with a volatile impregnant in a first zone;

recovering impregnated tobacco from the first zone and rapidly passing the impregnated tobacco through a discrete second zone wherein a gaseous phase containing a portion of the volatile impregnant is removed;

expanding tobacco from the second zone in a third discrete zone by contacting the tobacco with a stream of hot gases; and recovering the volatile impregnant removed in the second zone.

2. The process of claim 1 wherein the second zone is maintained at a pressure substantially below that of the first zone.

3. The process of claims 1 or 2 wherein tobacco is impregnated in the first zone by concurrently passing tobacco and gaseous impregnant concurrently through the first zone.

4. The process of claims 1 or 2 wherein the first zone is maintained at superatmospheric pressure.

5. The process of claim 3 wherein the first zone is maintained at superatmospheric pressure.

6. The process of claims 1 or 2 wherein the gaseous phase containing volatile impregnant removed from the second zone is passed countercurrently through a water scrubber.

7. The process of claim 6 wherein a portion of the stream of hot gases in the expansion zone is separated and passed through said water scrubber.

8. The process of claim 1 wherein the residence time of tobacco in said second zone is less than about five seconds.

9. The process of claim 2 wherein the residence time of tobacco in said second zone is less than about three seconds.

10. Apparatus for expanding tobacco comprising in combination; means for impregnating tobacco with a volatile impregnant; a separate, short residence time, vapor removal means downstream of the impregnation means for removing vapors produced by the volatile impregnant from impregnated tobacco; and expansion means downstream of the vapor removal means for contacting the tobacco with a stream of hot gas to thereby expand the tobacco.

11. The apparatus of claim 10 further comprising impregnant recovery means for recovering impregnant vapors removed by said vapor removal means.

12. The apparatus of claim 10 wherein said vapor removal means is constructed and arranged to provide a residence time of less than about five seconds for said impregnated tobacco.

13. The apparatus of claim 10 wherein said vapor removal means comprises pressure lock feed valves at its entrance and exit ends.

14. The apparatus of claim 11 wherein said impregnant removal means compress a packed tower scrubber for countercurrently contacting said impregnant vapors with water.

15. The process of claims 1, 8 or 9 wherein said volatile impregnant is condensed as a liquid within said tobacco in said first zone.

16. The process of claims 1, 8 or 9 wherein said process for increasing the filing capacity of tobacco is a continuous process.

* * * * *

UNITED STATES PATENT AND TRADEMARK OFFICE

CERTIFICATE OF CORRECTION

PATENT NO. : 4,870,980

DATED : October 3, 1989

INVENTOR(S) : Gerald R. Lowry

It is certified that error appears in the above—identified patent and that said Letters Patent is hereby corrected as shown below:

Column 3, line 39, "removal" should be --through--.

Signed and Sealed this

Eighteenth Day of September, 1990

*Attest:*

HARRY F. MANBECK, JR.

*Attesting Officer*

*Commissioner of Patents and Trademarks*